US005877453A

United States Patent [19]

Hill

[11] Patent Number: 5,877,453

[45] Date of Patent: Mar. 2, 1999

[54] COMPOSITE INSULATOR

[75] Inventor: Robert J. Hill, Franklin Park, Ill.

[73] Assignee: MacLean-Fogg Company, Franklin Park, Ill.

[21] Appl. No.: 932,754

[22] Filed: Sep. 17, 1997

[51] Int. Cl.[6] ..... H01B 17/06

[52] U.S. Cl. ..... 174/179; 174/195; 174/208; 385/138

[58] Field of Search ..... 174/179, 178, 174/208, 176, 169, 180, 182, 74 R, 75 R, 141 R, 150, 158 R, 192, 188, 189, 193, 148, 183, 195, 196, 212, 11 BH, 12 BH; 385/100, 137, 138

[56] References Cited

U.S. PATENT DOCUMENTS

| | | | |
|---|---|---|---|
| 959,929 | 5/1910 | Goddard | 200/48 R |
| 1,661,823 | 3/1928 | Hawley | 174/141 C |
| 2,405,425 | 8/1946 | Higgins . | |
| 2,732,423 | 1/1956 | Morrison . | |
| 3,134,164 | 5/1964 | Hocks . | |
| 3,328,515 | 6/1967 | Vose . | |
| 3,377,420 | 4/1968 | Brown et al. . | |
| 3,549,791 | 12/1970 | Yonkers . | |
| 3,808,352 | 4/1974 | Johnson . | |
| 3,898,372 | 8/1975 | Kalb . | |
| 4,057,687 | 11/1977 | Willem | 174/179 |
| 4,198,538 | 4/1980 | Lusk . | |
| 4,212,696 | 7/1980 | Lusk et al. . | |
| 4,246,696 | 1/1981 | Bauer et al. . | |
| 4,296,274 | 10/1981 | Cookson . | |
| 4,296,276 | 10/1981 | Ishihara et al. . | |
| 4,312,123 | 1/1982 | Wheeler . | |
| 4,331,833 | 5/1982 | Pargamin et al. . | |
| 4,343,966 | 8/1982 | Pargamin . | |
| 4,355,200 | 10/1982 | Wheeler et al. . | |
| 4,373,113 | 2/1983 | Winkler et al. . | |
| 4,427,843 | 1/1984 | Ishihara et al. . | |
| 4,435,615 | 3/1984 | Kaczerginski et al. . | |
| 4,440,975 | 4/1984 | Kaczerginski . | |
| 4,476,081 | 10/1984 | Kaczerginski et al. . | |
| 4,505,033 | 3/1985 | Wheeler . | |
| 4,604,498 | 8/1986 | Kuhl . | |
| 4,702,873 | 10/1987 | Kaczerginski | 264/135 |
| 4,714,800 | 12/1987 | Atkins et al. . | |
| 4,724,284 | 2/1988 | Wheeler . | |
| 4,749,824 | 6/1988 | Orbeck . | |
| 4,851,955 | 7/1989 | Doone et al. . | |
| 4,885,039 | 12/1989 | Thevenet . | |
| 4,905,118 | 2/1990 | Sakich . | |
| 5,159,158 | 10/1992 | Sakich et al. . | |
| 5,214,249 | 5/1993 | Goch et al. . | |
| 5,220,134 | 6/1993 | Novel et al. | 174/179 |
| 5,233,132 | 8/1993 | Soucille . | |
| 5,336,852 | 8/1994 | Goch et al. . | |
| 5,374,780 | 12/1994 | Pazdirek . | |
| 5,374,789 | 12/1994 | Bernstorf . | |
| 5,406,033 | 4/1995 | Pazdirek . | |
| 5,448,019 | 9/1995 | Berlovan, Jr. | 174/182 |
| 5,540,991 | 7/1996 | Hayakawa et al. . | |
| 5,563,379 | 10/1996 | Kunieda et al. . | |
| 5,633,478 | 5/1997 | Ishino . | |

FOREIGN PATENT DOCUMENTS

| | | | |
|---|---|---|---|
| 1345566 | 1/1974 | United Kingdom | 174/179 |
| 2063581 | 6/1981 | United Kingdom | 174/179 |
| 2200502 | 8/1988 | United Kingdom | 174/179 |

*Primary Examiner*—Kristine Kincaid
*Assistant Examiner*—Dhiru R. Patel
*Attorney, Agent, or Firm*—Richard G. Lione; Brinks Hofer Gilson & Lione

[57] ABSTRACT

A composite insulator with a silicone rubber sheath coating the insulator rod between metal fittings. Adjacent the line fitting, at least, a series of weathersheds are mounted on the rod and fastened to the sheath with their hubs in abutting relationship and with one hub abutting the line fitting. Another series of sheds are spaced from each other and from the series of weathersheds having their hubs in abutting relationship.

12 Claims, 1 Drawing Sheet

COMPOSITE INSULATOR

FIELD OF THE INVENTION

This invention relates generally to composite insulators of the type used to support high voltage electrical transmission lines. It relates particularly to applications in extremely contaminated environments where prolonged surface discharges may occur.

BACKGROUND OF THE INVENTION

Insulators for high voltage electrical transmission lines may take many forms. In recent years, composite insulators have become extremely popular. One such insulator comprises a rod fabricated of glass fiber impregnated with an organic binder. The rod is coated with a rubber insulating sheath and a plurality of rubber weathersheds are spaced along the rod and fastened to the sheath.

A composite insulator of this type normally has a high voltage electrode fitting fastened to the sheathed rod at one and a ground fitting fastened to the sheathed rod at the other end. Field experience has shown that the rubber sheath in the vicinity of the high voltage electrode end fitting can be susceptible to aging and/or erosion due to surface electrical discharges that can occur where extremely contaminated conditions exist.

SUMMARY OF THE INVENTION

An object of the present invention is to provide an improved composite insulator for highly contaminated environments which minimizes electrical discharges in the regions adjacent the end fittings.

It is another object to provide an improved composite insulator which has superior aging resistance.

Still another object is to provide an improved composite insulator which is less subject to water droplet corona, and related aging or erosion, than conventional composite insulator designs.

The foregoing and other objects are realized in accord with the present invention by providing a composite insulator with a predetermined irregular pattern and configuration of weathersheds on a sheathed rod. The rod is of known construction and is coated with a silicone rubber sheath in a conventional manner.

In one embodiment of the invention two separate series of differently configured weathersheds are mounted on the rod, over the sheath. A first series has convex upper and lower faces. These sheds abut each other and the high voltage electrode, completely shielding the rod. A second series has convex upper and concave lower faces. They are spaced from each other, the ground electrode and sheds of the one series. In another embodiment, intended for higher voltage applications, first and second series of sheds adjacent both fittings abut each other and the fittings. A third series of sheds between the first and second series comprises spaced sheds. In each embodiment, the sheds may be of alternated large and small diameter in each series.

BRIEF DESCRIPTION OF THE DRAWINGS

The foregoing and other objects of the invention are illustrated more or less diagrammatically in the drawings, in which.

DESCRIPTION OF THE PREFERRED EMBODIMENTS

Figure 1:
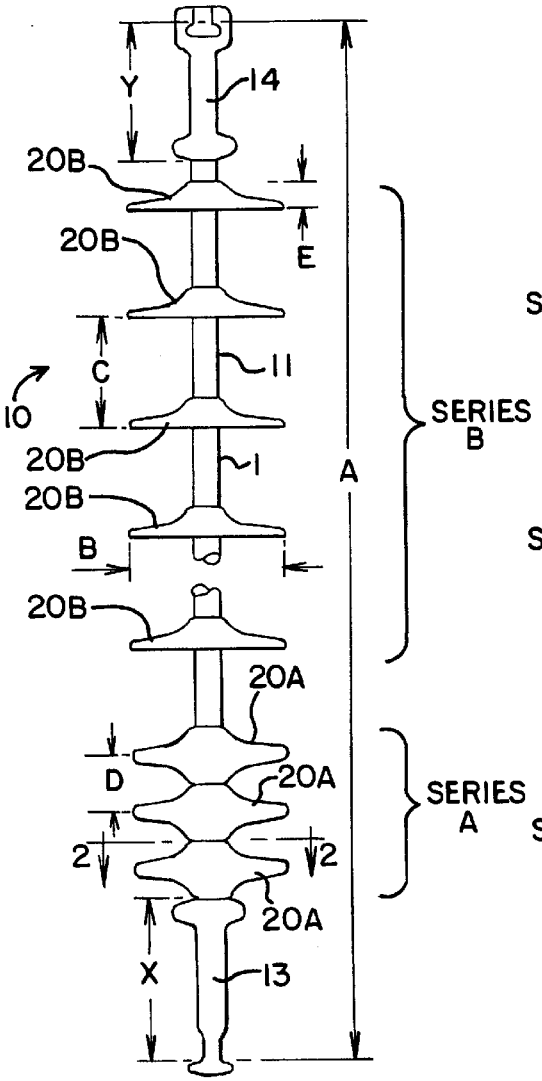
FIG. 1 is a front elevational view of an insulator embodying one form of the invention.
Figure 2:
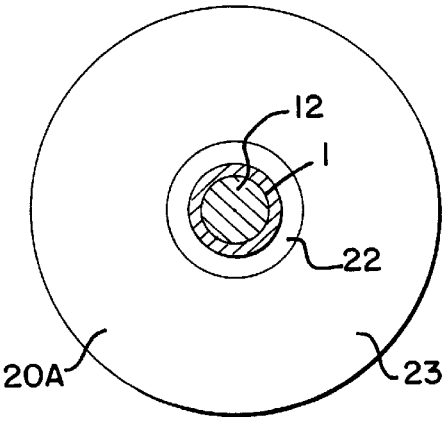
FIG. 2 is sectional view taken along line 2—2 of FIG. 1.

Referring now to the drawings, and particularly to FIGS. 1 and 2, a composite insulator embodying one form of the present invention is illustrated generally at 10. The insulator 10 comprises a rod 11 including an insulating rod core 12 having a metal, high voltage fitting 13 at one end and a metal, ground fitting 14 at the other end. A rubber sheath 18 covers the rod core 12 between the fittings 13 and 14, and a plurality of weathersheds 20 are mounted over the sheath.

The rod core 12 is fabricated in a well-known manner of glass fiber impregnated with an epoxy or other resin. The metal, high voltage fitting 13 is fastened to one end of the core 12 by conventional means, i.e., the core is inserted into a suitably configured bore (not shown) formed longitudinally into one end of the fitting and the fitting is crimped inwardly to grip the core with a retention force exceeding the axial load rating of the insulator. The metal ground fitting 14 is fastened to the other end of the rod core 12 in the same way.

The rod core 12 is coated with silicone rubber, which forms a sheath 18 on the core between the fittings 13 and 14. The coating is applied and cured in a conventional manner so that the sheath 18 adheres tightly to the core 12.

The sheath 18 provides a protective coating for the rod 11. At the same time, it provides a compatible mounting surface for the series of silicone rubber weathersheds 20 which are fastened to the sheath 18 with a silicone compound which creates a chemical bond as a result of a high temperature vulcanization process.

The weathersheds 20 are constructed and arranged on the rod 11 in a configuration and pattern embodying features of the invention. This configuration and pattern of weathersheds 20 is effective to limit the electrical stresses in the rod locations most susceptible to aging and/or erosion due to electrical surface discharges that can occur under highly contaminated conditions. The invention is also effective to minimize or eliminate water droplet corona and related aging or erosion. This is accomplished at a minimum cost.

The weathersheds 20 include first and second series A and B of separate and distinct weathershed configurations arranged in two separate and distinct patterns on the rod 11. The series A weathersheds 20A have a double-convex configuration and are stacked immediately adjacent each other on the rod 11 and against the high voltage electrode 13. The series B weathersheds 20B have a convex-concave configuration and are spaced a predetermined distance from each other on the rod 11 between the ground electrode 14 and the weathersheds 20A.

The series A weathersheds 20A each include a hub 22 which is adjacent the sheath 18 and a circular roof 23 which extends radially outwardly of the sheath. In this series A of weathersheds 20A, the hubs 22 and roofs 23 are symmetrical, top and bottom, as will be seen.

The series B weathersheds 20B each include a hub 26 which is adjacent to the sheath 18 and a circular roof 27 which extends radially outwardly of the sheath. In this series B of weathersheds 20B, the hubs 26 and roofs 27 are asymmetrical, top and bottom, as will be seen, i.e., unlike the A series of weathersheds 20A, their undersides or bottoms are concave.

An example of the aforedescribed composite insulator 10 (illustrated in FIG. 1) which has been tested has the following characteristics:

| | |
|---|---|
| length A (between end fitting connections) | 35 in/889 mm |
| high voltage fitting length X | 5.2 in/132 mm |
| ground fitting length Y | 5.0 in/127 mm |
| number of weathersheds | 8 |
| shed diameter B | 5.1 in/129 mm |
| shed (20A) length (along rod) | 0.625 in/15.5 mm |
| shed (20A) spacing D (edge-to-edge) | 4.07 in/103 mm |
| shed (20B) length E (along rod) | 1.25 in/31 mm |
| shed (20B) spacing C (edge-to-edge) | 1.25 in/31 mm |

This exemplary insulator 10 includes a first series A of three weathersheds 20A stacked together and mounted on the rod 11, abutting each other and the high voltage fitting 13. Five weathersheds 20B arranged in a second series B mounted on the rod 11 are spaced from each other and the fitting 14, as well as from the A series weathersheds 20A.

This pattern and configuration of weathersheds 20A and 20B on the rod sheath 18 eliminates axially exposed sheath 18 near the high voltage electrode 13. This greatly reduces the possibility of water droplet corona. At the same time, the cost of the insulator remains low because a spaced pattern of sheds 20B is used along the rest of the rod 11.

Figure 3:
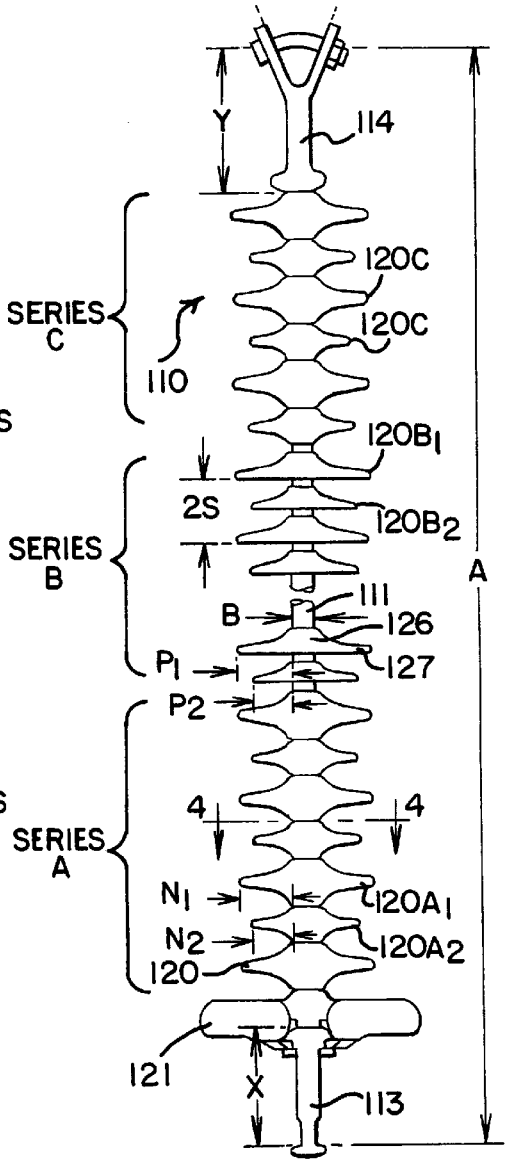
FIG. 3 is a front elevational view of an insulator embodying another form of the invention.
Figure 4:
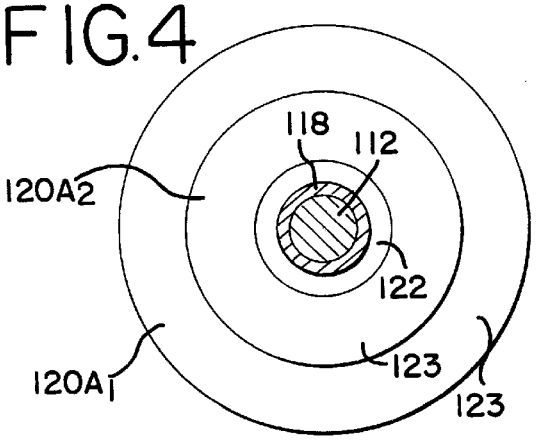
FIG. 4 is a sectional view taken along line 4—4 of FIG. 3.

Referring now to FIGS. 3 and 4, a composite insulator embodying another form of the present invention is illustrated generally at 110. The insulator 110 is specially adapted, according to the invention, for higher voltage applications than the insulator 10.

Like the insulator 10, the insulator 110 comprises a rod 111 including an insulating rod core 112 having a metal, high voltage fitting 113 at one end and a metal, ground fitting 114 at the other end. A rubber sheath 118 covers the rod core 112 between the fittings 113 and 114 and a plurality of weathersheds 120 are mounted on the rod 111 over the sheath.

The rod core 112, like the core 12, is fabricated of glass fiber impregnated with an epoxy resin. The high voltage fitting 113 and the ground fitting 114 are fastened to the core in the manner hereinbefore described in relation to the insulator 10.

The rod core 112 is coated with silicone rubber to form a sheath 118, in a manner which also has been described. Similarly, a series of silicone rubber weathersheds 120 are vulcanized to the sheath in a manner hereinbefore described. Unlike the insulator 10, in the insulator 110 a conventional corona ring 121 is adjacent the line end fitting 113.

The weathersheds 120 are also constructed and arranged on the rod 111 in a configuration and pattern embodying features of the invention. In higher voltage applications, this configuration and pattern of weathersheds 120 is also effective, at a minimum cost, to limit localized electrical stresses, minimize erosion and minimize or eliminate water droplet corona.

The weathersheds 120 include three series A, B and C of weathersheds 120A, 120B and 120C having separate and distinct configurations arranged in two separate and distinct patterns on the rod 111. The weathersheds 120A and 120C of the first and third series A and B of weathersheds have a double convex configuration and are stacked immediately adjacent each other on the rod 111 and against both the high voltage electrode 113 and the ground electrode 114. The weathersheds 120B of a second series B of series weathersheds have a convex-concave configuration and are spaced, on the rod 111, a predetermined distance from each other and from each of the first and third series A and C of weathersheds 120A and 120C.

The series 120A and 120C weathersheds each include a hub 122 and roof 123. The hubs 122 and roofs 123 are symmetrical, top and bottom, i.e., their upper sides or tops are convex while their undersides or bottoms are convex.

The series 120B weathersheds each include a hub 126 and a roof 127. The hubs 126 and roofs 127 are asymmetrical, top and bottom, i.e., their upper sides or tops are convex while their undersides or bottoms are concave.

An example of the aforedescribed composite insulator 110 (illustrated in FIG. 3) has the following characteristics:

| | |
|---|---|
| length A (between end fitting connections) | 86 in/2184 mm |
| high voltage fitting length X | 5.1 in/129 mm |
| ground fitting length Y | 6.6 in/168 mm |
| number of weathersheds | 52 |
| rod diameter B | 0.86 in/22 mm |
| shed (120A and 120C) radius (from rod) | |
| large N1 | 2.97 in/75 mm |
| small N2 | 2.82 in/71 mm |
| shed (120B) radius (from rod) | |
| large P1 | 2.97 in/75 mm |
| small P2 | 2.82 in/71 mm |
| shed (120B) spacing S (edge-to-edge) | 1.41 in/35.5 mm |

This exemplary insulator 110 includes a first series A of seven stacked weathersheds 120A mounted on the rod 111 abutting each other and the high voltage fitting 113. A third series C of seven weathersheds 120C are mounted on the rod 111 abutting each other and the ground fitting 114. Between them, a second series B of thirty-eight weathersheds 120B are mounted on the rod 111 in spaced relationship with each other and with the weathersheds 120A and 120C of the first and third series A and C of weathersheds.

As will be seen, the weathersheds 120A comprise alternating large diameter and small diameter, double-convex weathersheds. Four large diameter sheds 120A are separated by three small diameter sheds 120A. For ease of identification the reference numerals/letters for the large diameter sheds 102A are also given a subscript 1 while the reference numerals/letters for the small diameter sheds 120A are also given a subscript 2.

The weathersheds 120C also comprise alternating large diameter and small diameter, double-convex weathersheds. Four large diameter sheds 120B are separated by three small diameter sheds 120B. Again, subscripts 1 and 2 are used to distinguish large and small diameter weathersheds.

The second series B of weathersheds 120B comprise alternating large and small diameter, convex-concave weathersheds. As will be seen, they are spaced from each so that the rod 111 is exposed between them. Again, subscripts 1 and 2 are used to distinguish large and small diameter weathersheds.

This pattern and configuration of weathersheds 120A, 120B and 120C in each series A, B and C of weathersheds on the rod sheath 118 eliminates axially exposed sheath near both the high voltage electrode 113 and the ground electrode 114. Also, as previously discussed in relation to the insulator 10, it increases surface area adjacent these electrodes. Intermediate the weathersheds 120A and 120C of the first and third series A and C of sheds, the sheds 120B of the second series B are spaced apart to reduce cost and weight.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

I claim:

1. A composite insulator for supporting high voltage electrical transmission lines operating at voltages of from 66 to 765 kilovolts, comprising:

a) a rod formed of insulating material and having first and second ends;

b) first and second fittings fastened to said first and second rod ends, respectively;

c) a coating of elastomeric material forming a sheath over said rod which extends between said fittings;

d) a plurality of sheds fastened to said sheath, each of said sheds including a hub adjacent said sheath and a roof extending radially outwardly from said sheath; and e) said plurality of sheds including a first series of sheds adjacent said first fitting which have their hubs adjacent each other in abutting relationship and a second series of sheds spaced from said first fitting which have their hubs spaced from each other.

2. The composite insulator of claim 1 further characterized in that:

f) said plurality of sheds includes a third series of sheds adjacent said second fitting which have their hubs adjacent each other in abutting relationship.

3. The composite insulator of claim 2 further characterized in that:

g) said sheath and said sheds are each formed of silicone rubber.

4. The composite insulator of claim 2 further characterized in that:

g) said first series of sheds includes three or more sheds.

5. The composite insulator of claim 1 further characterized in that:

f) said first series of sheds includes three or more sheds.

6. The composite insulator of claim 1 further characterized in that:

f) said sheath and said sheds are each formed of silicone rubber.

7. The composite insulator of claims 1, 2, or 5 wherein at least one of said series of sheds includes sheds of alternating larger and smaller diameters.

8. A composite insulator for supporting high voltage transmission lines operating at voltages of from 66 to 765 kilovolts AC, comprising:

a) a rod formed of insulating material and having first and second ends;

b) a metal high voltage fitting fastened to said first end and a ground fitting fastened to said second end;

c) a coating of elastomeric material forming a sheath over said rod extending between said fittings;

d) a plurality of sheds fastened to said sheath, each of said sheds including a hub adjacent said sheath and a circular roof extending outwardly from said sheath;

e) said plurality of sheds including a first series of sheds adjacent said high voltage fitting which have their hubs adjacent each other in abutting relationship and a second series of sheds adjacent said ground fitting which have their hubs spaced from each other;

f) said first series of sheds including three or more sheds.

9. The composite insulator of claim 8 further characterized in that:

g) said first series of sheds has convex upper and lower faces and said second series of sheds has convex upper and concave lower faces.

10. A composite insulator for supporting high voltage transmission lines operating at voltages up to 765 kilovolts AC, comprising:

a) a rod core formed of insulating fiber and resin, said rod core having first and second ends;

b) a metal high voltage fitting fastened to said first end and a metal ground fitting fastened to said second end;

c) a coating of silicone rubber on the rod core, forming a sheath between the fittings;

d) a plurality of silicone rubber sheds encircling the rod core and sheath and bonded to said sheath;

e) each of said silicone rubber sheds including a central hub adjacent said sheath and a circular roof extending outwardly from said hub;

f) said plurality of sheds including a first series of sheds adjacent said high voltage fitting with their hubs abutting each other and said high voltage fitting;

g) said plurality of sheds including a second series of sheds adjacent said ground fitting with their hubs abutting each other and said ground fitting; and h) said plurality of sheds further including a third series of sheds between said first series and said second series, said third series of sheds including hubs spaced from each other and from the hubs of said first and second series of sheds.

11. A composite insulator for supporting high voltage transmission lines, comprising:

a) a rod core formed of insulating fiber and resin, said rod core having first and second ends;

b) a metal high voltage fitting fastened to said first end and a metal ground fitting fastened to said second end;

c) a coating of silicone rubber on the core, forming a sheath between the fittings;

d) a plurality of silicone rubber sheds encircling the rod and sheath and bonded to said sheath;

e) each of said silicone rubber sheds including a central hub adjacent said sheath and a circular roof extending outwardly from said hub;

f) said plurality of sheds including a first series of sheds adjacent said high voltage fitting with their hubs abutting each other and said high voltage fitting;

g) said plurality of sheds including a second series of sheds adjacent said ground fitting with their hubs spaced from each other.

12. The composite insulator of claim 11 further characterized in that:

h) the hubs of each of said second series of sheds are each spaced from said ground fitting.

* * * * *